United States Patent [19]

North et al.

[11] Patent Number: 4,511,254

[45] Date of Patent: Apr. 16, 1985

[54] CAVITATORS

[76] Inventors: Henry North, R.R. #16, Thunder Bay, Ontario, Canada, P7B 6B3; William R. Fauconnier, 1759 Meryle St., Thunder Bay, Ontario, Canada, P0T 2Z0

[21] Appl. No.: 447,009

[22] Filed: Dec. 6, 1982

[51] Int. Cl.[3] ..... B01F 11/00

[52] U.S. Cl. ..... 366/118; 366/128; 366/332; 241/172

[58] Field of Search ..... 48/189.4; 241/46.11, 241/46.17, 172; 261/81; 366/116, 117, 118, 124, 125, 128, 250, 256, 258, 279, 289, 315, 316, 317, 332

[56] References Cited

U.S. PATENT DOCUMENTS

| | | | |
|---|---|---|---|
| 3,417,966 | 12/1968 | Bodine | 366/116 |
| 3,567,185 | 3/1971 | Ross | 366/118 |
| 3,618,566 | 11/1971 | Walker | 366/116 |
| 4,211,121 | 7/1980 | Brown | 366/116 |
| 4,252,444 | 2/1981 | Herz | 366/117 |

FOREIGN PATENT DOCUMENTS

| | | | |
|---|---|---|---|
| 1108574 | 9/1981 | Canada . | |
| 856525 | 8/1981 | U.S.S.R. | 366/118 |

*Primary Examiner*—Robert W. Jenkins
*Assistant Examiner*—Arthur D. Dahlberg
*Attorney, Agent, or Firm*—Stanley G. Ade

[57] ABSTRACT

A cavitator comprising a cavitator plate mounted within a container is vibrated by an oscillator comprising a mechanically rotatable eccentric body to provide low frequency high power vibration. A mechanical linkage between the oscillator and the cavitator plate is tuned so that the frequency of oscillation matches the natural frequency of vibration of the linkage. The tuning can be achieved by modifying the length of the linkage or by choosing the necessary properties of the linkage or by varying the frequency of vibration of the oscillator. Various possible linkages include a pipe formed in sections, an elongated beam supported at its nodes, an annular pipe, and a pipe arrangement with overlapping section. The arrangement is of particular advantage when used with complex cavitator plates including vanes, paddles or rods or when using a cage grinder incorporating a plurality of balls for acting upon the material.

22 Claims, 10 Drawing Figures

CAVITATORS

BACKGROUND OF THE INVENTION

This invention relates to cavitators. It is known to act upon materials in the form of liquids or slurries by use of a plate or surface which is vibrated at small amplitude and high frequency. Particularly, the material to be acted upon can either be maintained in a stationary tank or passed through a duct into a container in which the vibrating plate is mounted to achieve continuous flow. The vibrating plate acts to form bubbles in the material adjacent the surface as it vibrates. Such action is known as cavitation. This can be used to mix the material, as an emulsifier or to initiate or speed up chemical reactions which take place within the container.

In order to oscillate the cavitation plate, the plate is connected by communication means to an oscillator vibrating at high frequency. Todate, all such oscillators have used electromagnetic techniques which provide frequencies lying in the range of 16,000 Hz to 1,000,000 Hz that is above the audible range or in the ultrasonic range. One megaHz is the practical upper limit for cavitation. In view of the electromagnetic forces involved, such ultrasonic devices have a fixed force output and are severely restricted in the total output available.

SUMMARY OF THE INVENTION

In accordance with the invention there is provided a cavitator comprising a chamber, means for admitting and removing material from the chamber, a cavitator plate, means mounting the cavitator plate within the chamber for oscillatory movement therein, oscillation means including an eccentric member and means for rotating the member about an axis to produce oscillatory movement and means for communicating the oscillatory movement to the cavitator plate.

For a particular advantage, the apparatus is tuned so that the frequency of oscillatory movement and the natural frequency of vibration of the communicating means are the same or substantially the same or one is substantially a whole number multiple of the other. This provides an arrangement wherein substantially the whole of the power provided by the oscillator is communicated to the cavitation plate without undesirable losses.

Such a tuning of the apparatus can be achieved either by varying the oscillation speed of the oscillator or by varying the natural frequency of vibration of the communicating means. The latter can be achieved by suitable choice of the material of the communicating means or by varying the length of the communicating means by introducing or removing separate sections or by increasing or decreasing an overlapping section. This can be achieved automatically if required, or can be preset during manufacture.

It is an advantage of this invention that the cavitator plate operates at medium frequency, generally below inaudible frequencies, as low as 100 to 150 Hz. This enables the use of larger amplitude oscillations which make possible very high energy transfers. When two sides of the plate are exposed to the material, such high energy transfers enable two-sided cavitation to take place.

It is a further advantage of the invention that the use of mechanically rotating members to produce the oscillation enables the use of very large oscillators providing up to 1,000 HP. Such mechanical oscillators are now commercially available.

Another advantage of this invention is that it enables the use of complex shaped cavitator plates which provide improved movement of the material surrounding the cavitator plate and hence improved mixing. Such improved movement can be achieved by vanes provided on the cavitator plate which rotate the material or by rods extending from the cavitator plate in the plane thereof which tend to form vortexes in the material thus assisting mixing.

A yet further advantage of the invention is that the high power available can be used to operate a cavitator plate comprising a cage grinder in which the plate comprises a container into and out of which the material can pass and containing a plurality of grinding balls which act upon the material within the container.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
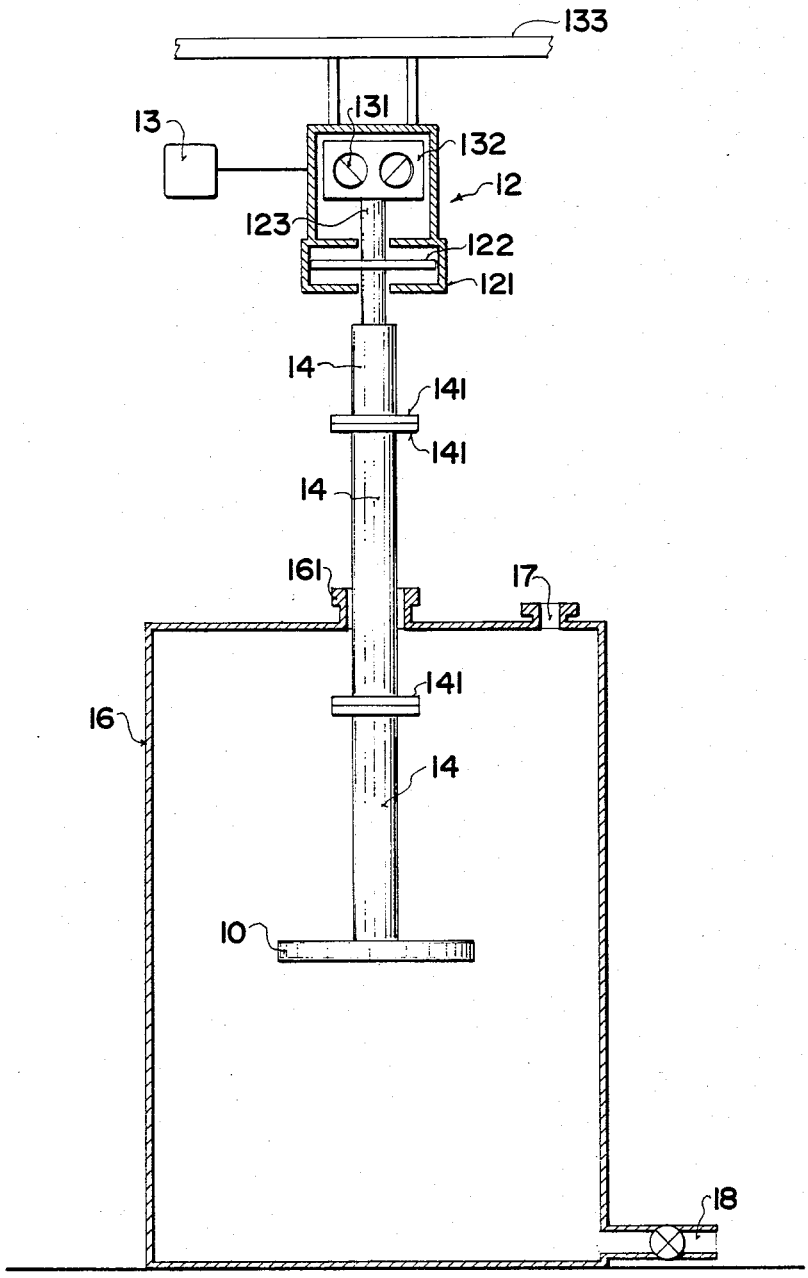
FIG. 1 is a schematic cross sectional view of a cavitator according to the invention with the oscillator vertically above the cavitator plate.

Referring firstly to FIG. 1, the high energy transfer cavitator assembly comprises a cavitator plate 10 which is shown simply as a flat plate lying in a plane extending at right angles to the direction of oscillation of the plate, a variable frequency oscillator 12 and an elongated connecting pipe 14 extending from the oscillator to the plate. The plate is mounted within a container 16 for receiving the material to be acted upon through an inlet 17. An outlet pipe 18 enables the material to be ejected after the process has been completed.

The oscillator 12 comprises a mechanical oscillator which is commercially available, for example, from Hawker Siddeley Limited and comprises a pair of rotary bodies 131, 132 carried in chambers in the main body of the oscillator together with a hydraulic pump schematically indicated at 13 which supplies pressurized fluid for driving the rotation of the bodies 131 and 132. The rate of rotation of the bodies can be varied by adjusting the fluid pressure so as to increase or decrease the frequency of vibration. The oscillator 12 in this embodiment is suspended from an overhead support structure schematically indicated at 133. The oscillator 12 incorporates a cylinder 121 within which a piston 122 slides on an output shaft 123 of the oscillator. The piston and cylinder 121, 122 provides an air spring so as to limit the amplitude of the vibration produced by the oscillator 12. The shaft 123 is connected to the oscillation communication means 14 which comprises a steel pipe extending linearly from the output shaft 123 to the cavitator plate 10. This piston and cylinder 121, 122, together with an opening 161 in the container 16 provide bearings which allow small amplitude sliding movements of the pipe 14 so that the oscillation can be communicated from the output shaft 123 to the cavitator plate 10.

The apparatus is tuned so that the frequency of oscillation of the oscillator 12 is the same as or substantially the same as the natural frequency of vibration of the pipe 14. This ensures that the maximum power is communicated from the oscillator to the cavitator plate without substantial losses. It is also acceptable for the tuning that one of the oscillation frequency and the natural vibration frequency is a whole number multiple of the other.

The tuning is achieved firstly by suitable selection of the pipe 14. Such criteria for selection will include the diameter of the pipe, the thickness of the pipe, the material of the pipe and the length of the pipe. The material itself has an effect on the modulus of elasticity of the pipe which affects the natural vibration frequency. Using a pipe of a particular diameter, thickness and material, tuning is then achieved by varying the length of the pipe. For this purpose, the pipe is comprised of a number of separate sections, each of which carries a flange 141 on each end so that the sections can be clamped together suitably by bolts. In order to increase the length of the pipe therefore a further section can be added by separating two of the sections and inserting a further section. Similarly, the length can be decreased by removing one of the sections. Such a method of tuning the apparatus is relatively crude, but in practice has been found to be satisfactory.

Alternatively, or in addition, tuning can be achieved by varying the oscillation rate of the oscillator 12 and this can be used as a fine tuning method after the pipe has been selected. Materials to be acted upon are loaded into the chamber 16 through the inlet 17 and according to one example, are acted upon by oscillations having a force lying in the range 30,000 to 225,000 lbs. at a frequency of 130 Hz with a displacement amplitude in the range 0.2 ins. The energy thus introduced into the material causes cavitation which can be used to mix the material, to emulsify the material or to accelerate or initiate chemical reactions.

Figure 2:
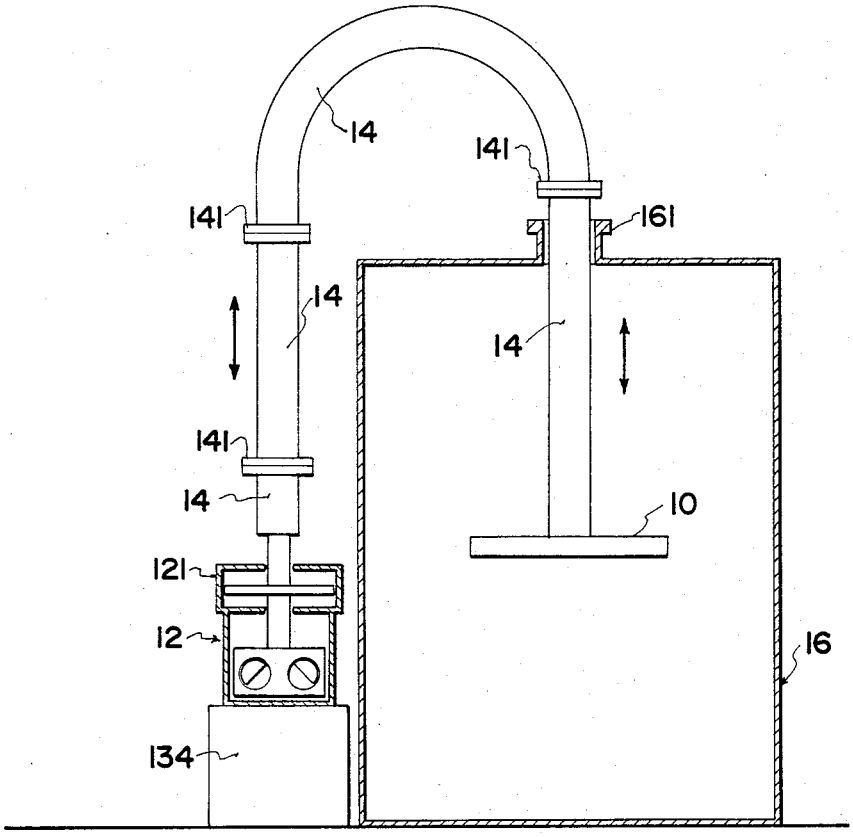
FIG. 2 is a similar view to that of FIG. 1 of the cavitator showing the oscillator in different orientation.

Turning now to FIG. 2, the apparatus disclosed is substantially the same as that of FIG. 1 except that the oscillator 12 is not suspended from an overhead support but instead is supported from floor level on a further support 134. In this case, the pipe 14 is no longer linear but incorporates one section which is curved with a constant radius of curvature.

Figure 3:
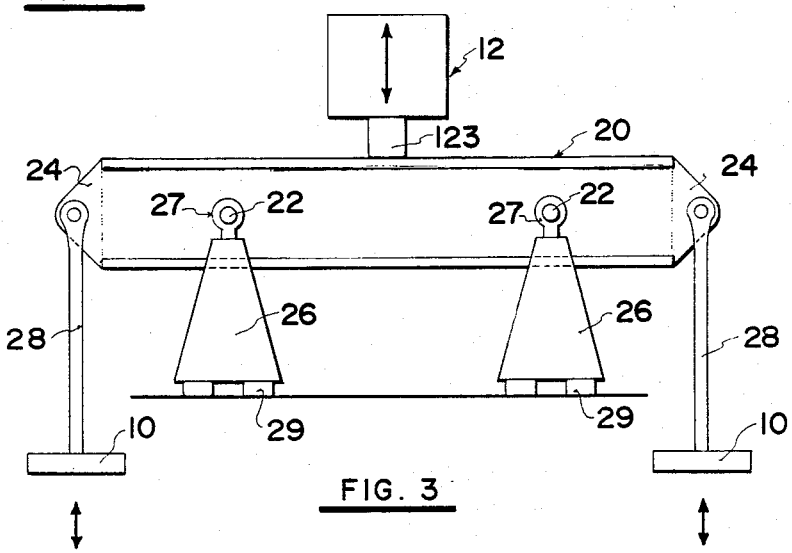
FIG. 3 is a schematic side view of a further embodiment incorporating a different form of vibration communication means.

Turning now to FIG. 3, there is shown an alternative form of communicating means for communicating from the oscillator which is schematically shown at 12 to a pair of cavitator plates shown at 10. The communication means or condenser comprises a steel beam 20 of I cross section. The output shaft 123 of the oscillator is connected at the centre of the beam 20 so as to cause vertical oscillatory movement of the beam. Such movement is transferred to the ends 24 of the beam which are connected to two cavitator plates 10 through rigid links 28. In view of the flexing of the beam, the oscillator sets up vibrations in the beam. The dimensions, material and thickness of the beam are so selected in conjunction with the frequency of the oscillator 12 such that the natural frequency of vibration of the beam is tuned to the frequency of the oscillator as previously explained. In this way, resonant vibrations are set up in the beam which have stationary node points within the beam. In order to support the I beam, pins 22 are mounted through the beam and are carried on support members 26 which comprise a collar 27 surrounding the respective pin 22, which collar is carried on frusto-conical support member in turn carried upon resilient supports 29. The supports 29 may comprise air or rubber mounting cushions which allow vibration of the rigid supports 26.

In an alternative arrangement not shown, the oscillator 12 is located at one end of the beam in place of one of the links 28 connected to the respective cavitator plate 10.

Figure 4:
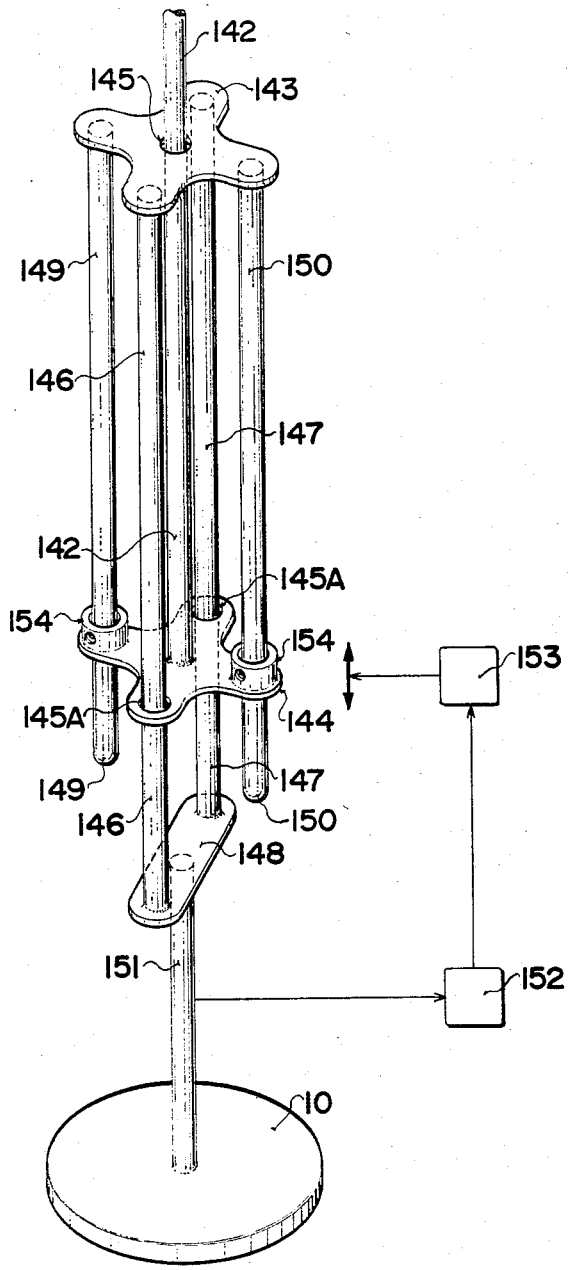
FIG. 4 is a schematic isometric view of a further embodiment of oscillation communication means incorporating an overlapped portion.

Turning now to FIG. 4, there is shown an alternative form of communication means between the oscillator 12 and the cavitator plate 10 which can be introduced into the pipe section 14 of FIG. 1 to provide a method of adjusting the length of the pipe 14 without the necessity of removing or adding separate pipe sections and with the facility of a gradual as opposed to stepped variation in the length.

The apparatus comprises a first pipe section 142 passing through a cruciform plate 143 and fixed to a second cruciform plate 144. A guide bushing 145 in the plate 143 enables oscillatory movement of the pipe 142 to pass through the plate 143 to be communicated to the plate 144. Further pipes 146 and 147 are connected to the plate 143 and pass through similar guide bushings 145A in the plate 144 to a further plate 148 to which they are affixed. Pipes 149, 150 interconnect the cruciform plates 143 and 144. Finally, a pipe 151 connected to the plate 148 is connected to the cavitator plate.

Thus, oscillation communicated to the pipe 142 from the oscillator 12 is communicated through the overlapping section comprising the cruciform plates 143 and 144 to the plate 148 and thence to the cavitator plate via the pipe 151. The guide bushings 145 and 145A allow ready communication of the oscillatory motion. The pipe 142 is connected to the plate 144 and similarly the pipes 149 and 150 are connected to the plate 144 by collet clamps 154 which allow the length of overlap between the plates 143 and 144 to be adjusted. In this way, the natural frequency of vibration of the total device can be adjusted to tune with the frequency of the oscillator 12.

In an alternative arrangement, means schematically indicated at 152 are provided for continuously monitoring whether the apparatus is tuned, that is, the natural frequency of the communication means matches the frequency of oscillation of the oscillator 12. In dependence upon such continuous monitoring means schematically indicated at 153 is provided for automatically adjusting the length of overlap between the plates 143 and 144 so as to maintain the apparatus tuned at all times regardless of any variations in the oscillation rate or of the properties of the material acted upon by the cavitator plate 10.

Figure 5:
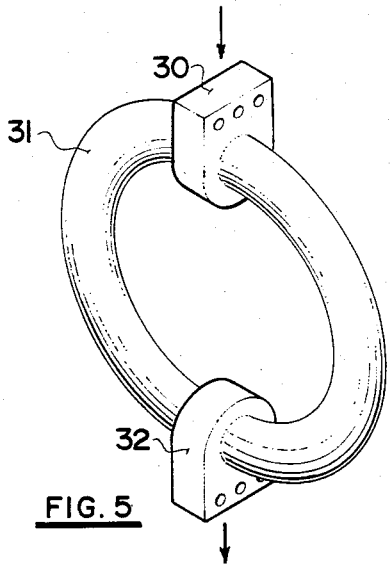
FIG. 5 is a further schematic isometric view of a yet further embodiment of communication means.

A further communicating means is shown in FIG. 5 in which the output shaft 123 of the oscillator 12 is attached to a first grip plate 30 which forms a collar around an annular pipe 31. A second grip plate 32 positioned diametrically opposite to the first grip plate 30 and attached similarly is connected to the cavitator plate via a further pipe linkage (not shown).

The annular pipe 31 can be tuned by suitable choice of the radius of curvature, cross sectional area and material.

In FIGS. 6, 7, 8 and 9 are disclosed various forms of complex cavitator plate which can be advantageously used with the apparatus of FIG. 1 or the apparatus of FIG. 1 as modified by FIGS. 3, 4 and 5. In all embodiments, the cavitator plate comprises a circular base member lying in a plane at right angles to the direction of oscillatory movement, such member being indicated at 40. In some of the base members 40, there are provided openings 41 which allow the material to pass through to aid the mixing process where necessary.

Figure 6:
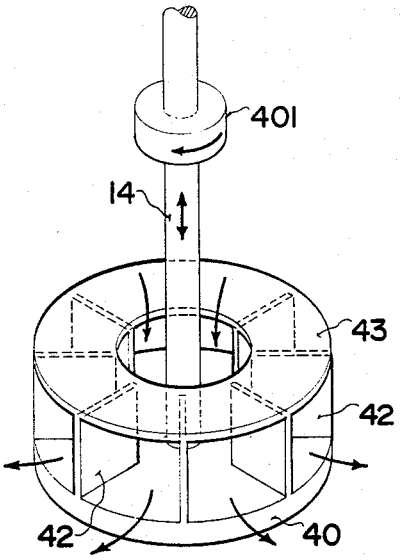
FIG. 6 is an enlarged schematic isometric view of a first embodiment of a more complex cavitator plate for use with the apparatus of FIG. 1.

In FIG. 6, the base member 40 is modified by the addition of upstanding vanes 42 which lie at right angles to the plane of the plate 40, which vanes are supported at their upper end by an annulus 43. In addition, there are provided in FIG. 6, means schematically indicated at 401 for rotating the cavitator plate about an axis parallel to the direction of oscillatory movement so that the vanes act to rotate the material about the same axis to assist movement of the material between the vanes and around the plate.

Figure 7:
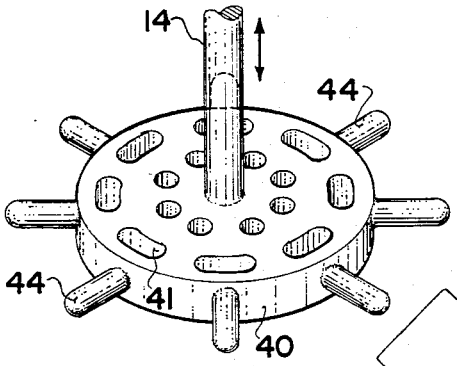
FIG. 7 is a similar view to FIG. 6 of a second embodiment of complex cavitator plate.

In FIG. 7, the base plate 40 is supplemented by radial rods 44 lying in the same plane as the base plate so that oscillatory movement of the base plate causes similar movement of the rods 44 which then act to form vortexes around the rods in the material thus assisting movement of the material.

Figure 8A:
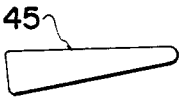
FIG. 8A is a side view of one vane of FIG. 8.
Figure 8:
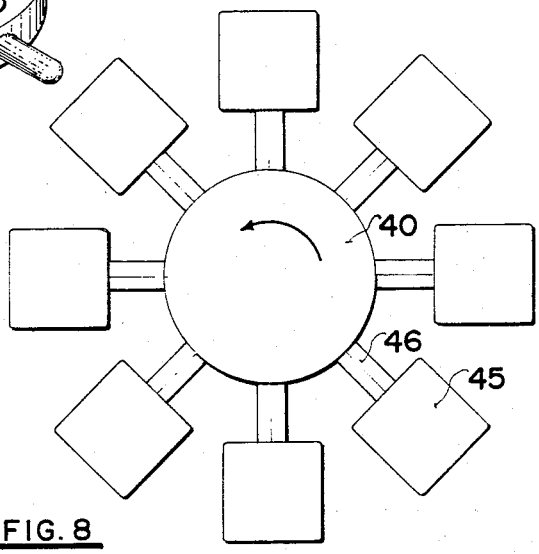
FIG. 8 is a plan view of a yet further embodiment of complex cavitator plate for use with the apparatus of FIG. 1.

In FIG. 8, the base member 40 is modified by the addition of vanes 45 extending radially from the base member and carried on rods 46. The vanes are inclined at a shallow angle, typically 6 degrees to the plane of the base member 40 so that the oscillatory motion of the base member 40 causes similar movement of the vanes 45 which therefore tends to rotate the plate about an axis parallel to the direction of oscillatory movement.

Figure 9:
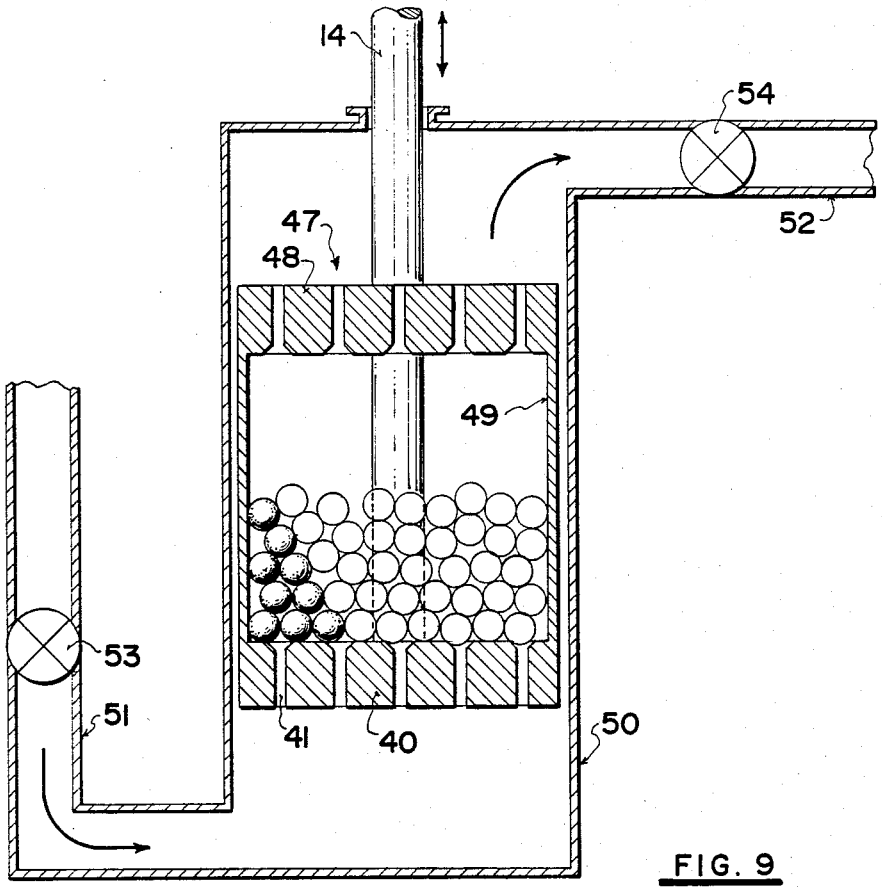
FIG. 9 is a schematic cross sectional view of a complex cavitator plate and container for replacing the container and cavitator plate of FIG. 1.

In FIG. 9, the base member 40 forms the bottom of a cage 47 including an upper member 48 similar to the base member 40 and a cylindrical wall 49. The container or cage thus formed contains a plurality of balls so that the material forced into the cage or container by the movement of the base member 40, passes between the balls and is acted upon by the balls to grind the material. In order to assist movement of the material through the cage or container 47, the cage 47 is mounted within a container, the wall of which lie closely adjacent the outer circumferential wall 49 of the cage. Thus, material enters the container 50 from a pipe 51 at one end of the container through a further pipe 52. Control valves 53 and 54 are provided in the inlet and outlet pipes 51 and 52 respectively.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A cavitator comprising a chamber, means for admitting and removing fluid material from the chamber, a cavitator plate having opposed cavitator surfaces, means mounting the cavitator plate within the chamber so as to expose both said surfaces to fluid material in said chamber, (for oscillatory movement therein,) high power sonic frequency oscillation means including an eccentric member and means for rotating the member about an axis to produce oscillatory movements and mechanical interconnection means for communicating the oscillatory movement to the cavitator plate (.) whereby said plate causes cavitation of said fluid material, said communicating means having a natural frequency of vibration dependent upon its mechanical construction, the frequency of the oscillatory movement and the natural frequency being arranged such that one is substantially a whole number multiple of the other.

2. A cavitator according to claim 1 including means for adjusting the oscillation means to vary the frequency of the oscillatory movement.

3. A cavitator according to claim 1 wherein the communication means is arranged such that the distance between the oscillation means and the cavitator plate can be adjusted to adjust the natural frequency of vibration of the communication means.

4. A cavitator according to claim 3 wherein the communication means comprises a plurality of sections such that sections can be removed and additional sections added to adjust the length of the communication means.

5. A cavitator according to claim 4 wherein the sections each carry a flange at each end thereof such that the flange of one section can be connected to the flange of an adjacent and abutting section.

6. A cavitator according to claim 3 wherein the communication means comprises two sections arranged such that one section overlaps the other, and means for increasing and decreasing the length of overlap so as to adjust the length and therefore the natural frequency of vibration of the communication means.

7. A cavitator according to claims 3 or 6 including means for detecting whether one of the natural frequency of the communicating means and the frequency of oscillatory movement is substantially a whole number multiple of the other and means for automatically adjusting the distance between the oscillation means and the cavitator plate in dependence thereon.

8. A cavitator according to claim 1 wherein the communicating means comprises at least one pipe section.

9. A cavitator according to claim 1 wherein the communicating means extends linearly from the oscillation means to the cavitator plate.

10. A cavitator according to claim 1 wherein the communicating means includes a portion having a radius of curvature.

11. A cavitator according to claim 1 wherein the oscillation means includes two eccentric members and means for rotating the members about respective axes.

12. A cavitator according to claim 1 including hydraulic drive means for rotating the member.

13. A cavitator according to claim 1 wherein the communicating means comprises an elongated member extending substantially at right angles to the direction of the oscillatory movement, means connecting the oscillation means at a first position along the length of the member and means connecting the cavitator plate to a second position along the length of the member spaced from the first position.

14. A cavitator according to claim 13 including means for supporting the member at spaced positions along its length, said means being arranged to support the member at positions which constitute nodes in the vibration of the member.

15. A cavitator according to claim 14 wherein the support means includes resilient mounting means.

16. A cavitator according to claims 13, 14 or 15 wherein the oscillation means is connected to the member at the mid-point thereof and wherein there are provided means mounting a first and a second cavitator plate at respective ends of the members.

17. A cavitator according to claim 1 wherein the communicating means includes an annular pipe, means connecting the oscillation means to a first position on the annular pipe and means connecting the cavitator plate to a second position on the annular pipe diametrically opposed from the first position.

18. A cavitator according to claim 1 including means for rotating the cavitator plate about an axis substantially parallel to the direction of oscillatory movement thereof and a plurality of vanes extending substantially at right angles to the plate and radially to the axis whereby to enhance movement of the material surrounding the plate.

19. A cavitator according to claim 1 wherein the cavitator plate includes a plurality of vanes each lying at a shallow angle to the plane of the plate whereby the oscillatory movement of the plate induces rotation of the plate about an axis parallel to the direction of oscillatory movement.

20. A cavitator according to claim 1 wherein the cavitator plate includes a plurality of rods extending from the periphery thereof and lying in the plane of the plate whereby the oscillatory movement causes vortexes in the material surrounding the plate.

21. A cavitator according to claim 1 wherein the cavitator plate comprises a container with openings to allow the entry and exit of material surrounding the plate and a plurality of grinding balls located within the container so as to act upon the material entering the container.

22. A cavitator comprising a chamber, means for admitting and removing fluid material from the chamber, a cavitator plate having opposed cavitator surfaces, means mounting the cavitator plate within the chamber so as to expose both said surfaces to fluid material in said chamber, high power sonic frequency oscillation means including an eccentric member and means for rotating the member about an axis to produce oscillatory movements and mechanical interconnection means for communicating the oscillatory movement to the cavitator plate whereby said plate causes cavitation of said fluid material, said communicating means having a natural frequency of vibration dependent upon its mechanical construction, the frequency of the oscillatory movement and the natural frequency being arranged such that one is substantially a whole number multiple of the other, wherein the communicating means comprises a donut shaped tubular body having said oscillator attached to an outer edge thereof and said cavitator plate attached to a radially opposed outer edge thereof.

* * * * *